US007520198B1

(12) United States Patent
Lin

(10) Patent No.: US 7,520,198 B1
(45) Date of Patent: Apr. 21, 2009

(54) RATCHET SCREWDRIVER

(76) Inventor: Chia-Yun Lin, No. 14, Lane 155, Sec. 3, Situn Rd., Situn Dist., Taichung (TW)

( * ) Notice: Subject to any disclaimer, the term of this patent is extended or adjusted under 35 U.S.C. 154(b) by 0 days.

(21) Appl. No.: 11/983,185

(22) Filed: Nov. 7, 2007

(51) Int. Cl.
*B25B 13/46* (2006.01)

(52) U.S. Cl. ..... 81/63; 81/60

(58) Field of Classification Search ..... 81/60–63.2, 81/58, 58.1
See application file for complete search history.

(56) References Cited

U.S. PATENT DOCUMENTS 2,351,996 A * 6/1944 Morgan ..... 192/54.5
2,649,176 A * 8/1953 Winger ..... 192/43
3,824,881 A * 7/1974 Wright ..... 81/63
4,102,375 A * 7/1978 Rossini ..... 81/30
4,488,460 A * 12/1984 Ballone et al. ..... 81/60
5,211,086 A * 5/1993 Shu ..... 81/58.1
5,520,073 A * 5/1996 Bakula et al. ..... 81/63.1
5,711,193 A * 1/1998 Eggert et al. ..... 81/63.1
5,749,271 A * 5/1998 Liu ..... 81/60
5,894,765 A * 4/1999 Anderson et al. ..... 81/60

* cited by examiner

*Primary Examiner*—David B Thomas
(74) *Attorney, Agent, or Firm*—Wegman, Hessler & Vanderburg

(57) ABSTRACT

A ratchet screwdriver includes a handle, a ratchet, a shaft and a finger ring. The handle has a body having a receiving chamber and a front through hole. The receiving chamber is formed in the body and communicates with the front through hole. The ratchet is mounted in the receiving chamber and has a keyed driving protrusion and a drive selector. The shaft is mounted rotatably in the body and has a proximal end being mounted securely on the keyed driving protrusion. The finger ring is mounted securely around the shaft outside the body and is smaller than the handle to allow quick and easy rotation of the shaft.

8 Claims, 6 Drawing Sheets

RATCHET SCREWDRIVER

BACKGROUND OF THE INVENTION

1. Field of Invention

The present invention relates to a hand tool, and more particularly to a ratchet screwdriver that can be rotated quickly and easily.

2. Description of the Related Art

When a conventional ratchet screwdriver is turned to tighten or loosen a fastener, a handle of the conventional ratchet screwdriver is rotated in multiple positive turns with a ratchet disengaging during a negative turn and re-engaging for another positive turn.

Because during starting off tightening and finishing off loosening requires little torque, rotating the handle of the conventional ratchet screwdriver is tiring, time wasting, troublesome and causes discomfort to a user.

To overcome the shortcomings, the present invention provides a ratchet screwdriver to mitigate or obviate the aforementioned problems.

SUMMARY OF THE INVENTION

The primary objective of the present invention is to provide a ratchet screwdriver that can be turned quickly and easily.

The ratchet screwdriver in accordance with the present invention comprises a handle, a ratchet, a shaft and a finger ring.

The handle comprises a body having a receiving chamber and a front through hole. The receiving chamber is formed in the body and communicates with the front through hole. The ratchet is mounted in the receiving chamber and has a keyed driving protrusion and a drive selector. The shaft is mounted rotatably in the body and has a proximal end being mounted securely on the keyed driving protrusion of the ratchet.

The finger ring is mounted securely around the driving rod of the shaft outside the body and is smaller than the handle to allow quick and easy rotation of the shaft without rotating the handle.

Other objectives, advantages and novel features of the invention will become more apparent from the following detailed description when taken in conjunction with the accompanying drawings.

DETAILED DESCRIPTION OF THE INVENTION

Figure 1:
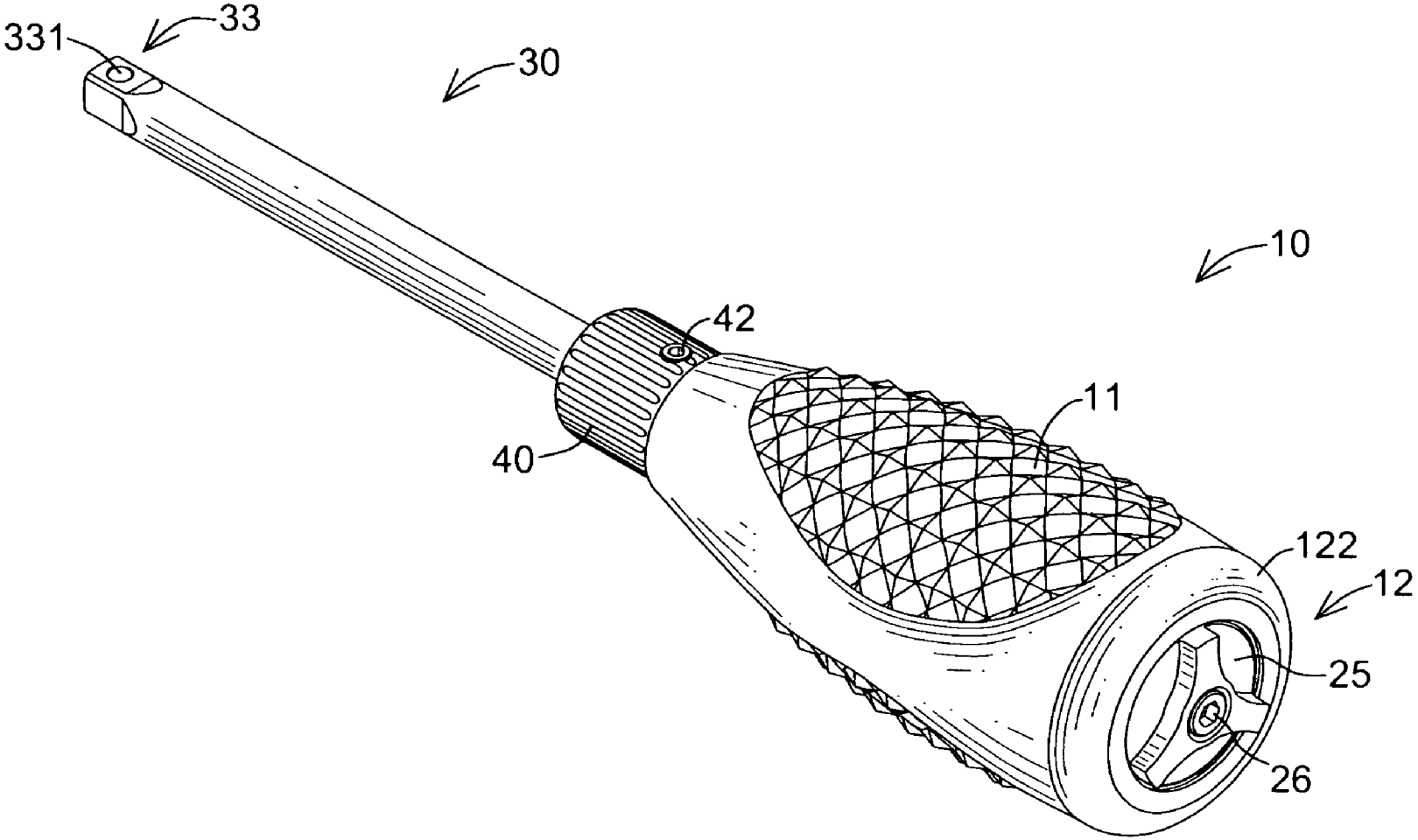
FIG. 1 is a perspective view of a ratchet screwdriver in accordance with the present invention.
Figure 2:
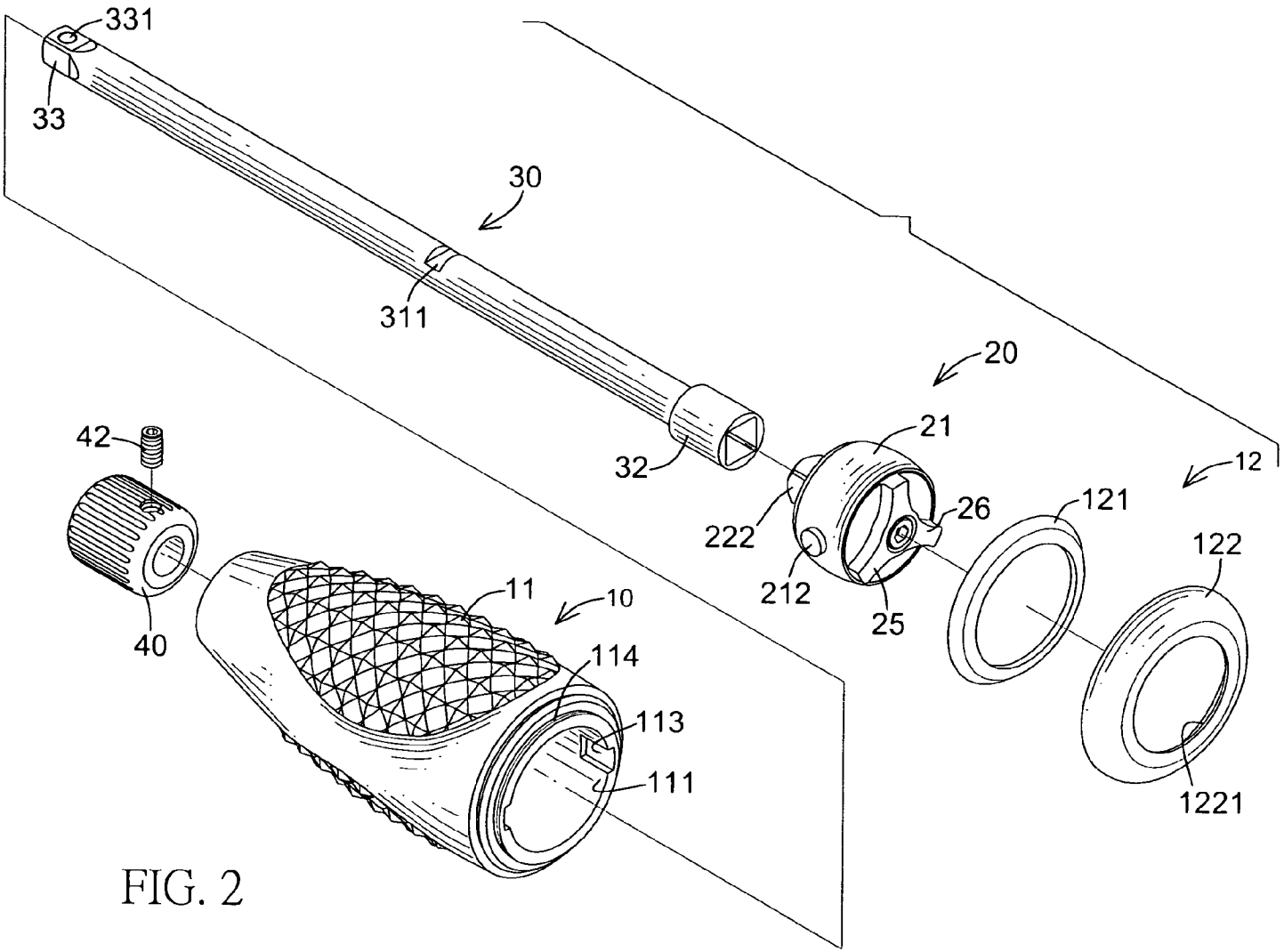
FIG. 2 is an exploded perspective view of the ratchet screwdriver in FIG. 1.
Figure 3:
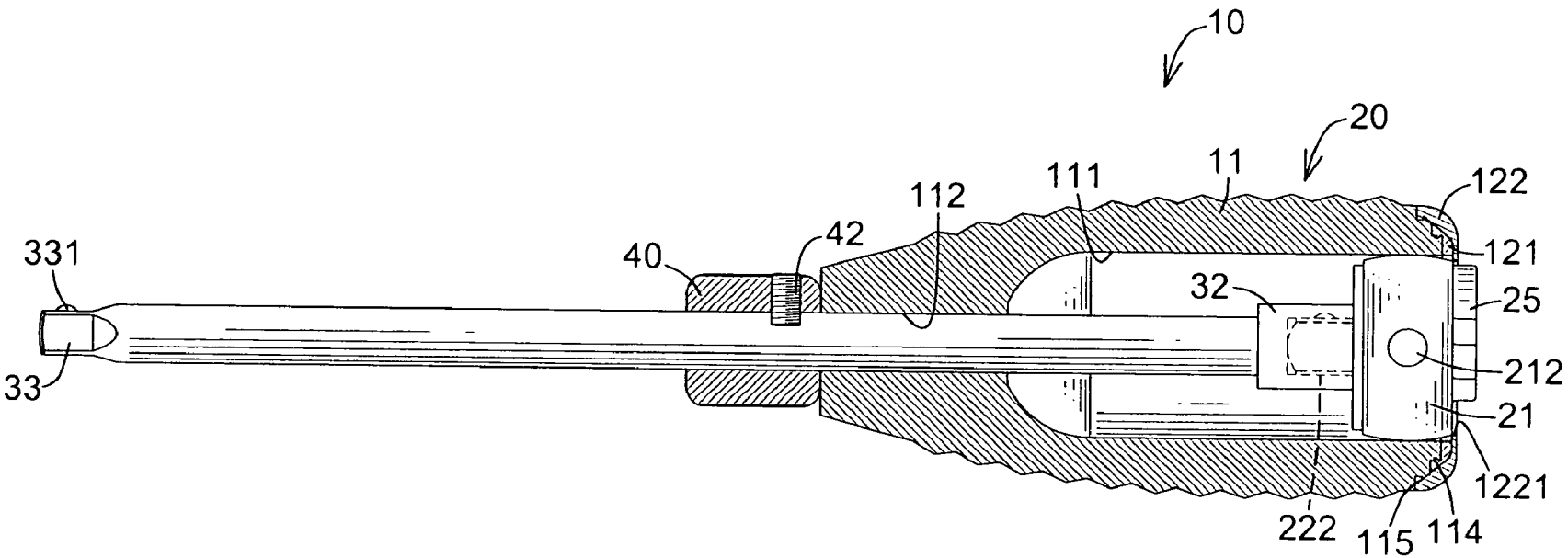
FIG. 3 is a side view in partial cross section of the ratchet screwdriver in FIG. 1.

With reference to FIGS. 1 to 3, a ratchet screwdriver in accordance with the present invention comprises a handle (10), a ratchet (20), a shaft (30) and a finger ring (40).

The handle (10) comprises a body (11) and an optional cap (12). The body (11) has a front end, a rear end, an inner surface, a receiving chamber (111), a front through hole (112), two optional mounting recesses (113), an optional mounting protrusion (114) and an optional annular lip (115). The receiving chamber (111) is defined in the body (11) at the rear end and has an opening in the rear end of the body (11). The front through hole (112) is defined through the front end of the body (11) and communicates with the receiving chamber (111). The mounting recesses (113) are formed oppositely in the inner surface of the body adjacent to the rear end of the body (11). The mounting protrusion (114) is smaller than, is formed concentrically on and protrudes axially from the rear end of the body (11) around the opening of the receiving chamber (111) and may be threaded. The annular lip (115) is larger than, is formed on and protrudes from the mounting protrusion (114).

The cap (12) is mounted on the rear end of the body (11) and comprises a threaded ring (121), a cover ring (122) and a rear through hole (1221). The threaded ring (121) is mounted on the mounting protrusion (114) of the body (11) and closes the mounting recesses (113) in the rear end of body (11). The cover 19 ring (122) corresponds to and is mounted on the annular lip (115) of the body (11). The rear through hole (1221) is formed axially through the cap (12) and communicates with the receiving chamber (111).

Figure 4:
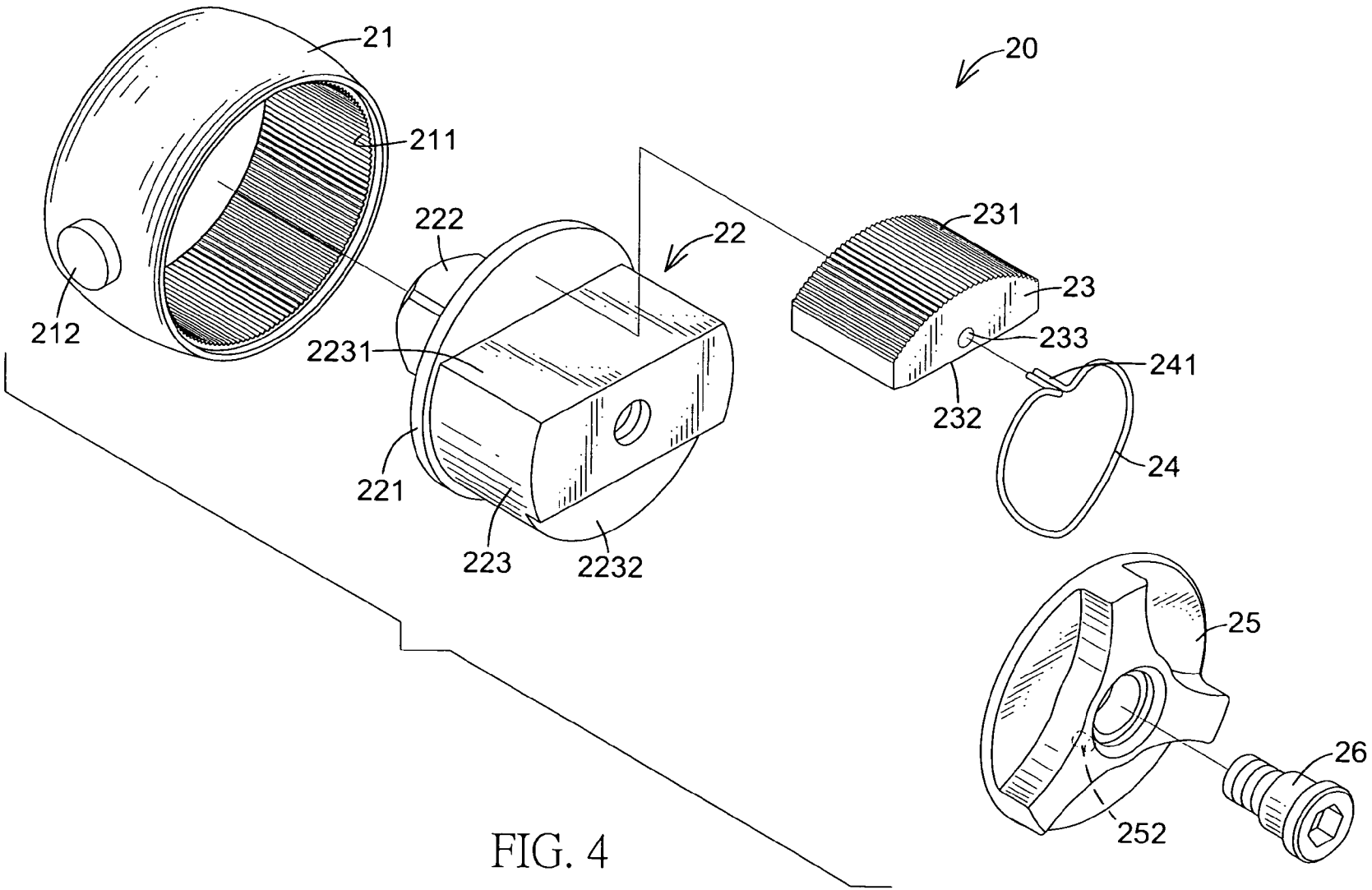
FIG. 4 is an exploded perspective view of a ratchet of the ratchet screwdriver in FIG. 1.

With further reference to FIG. 4, the ratchet (20) is mounted in the opening of the receiving chamber (111) and may comprise a driving sleeve (21), a rotating member (22), a teeth block (23), a heart-shaped spring (24), a drive selector (25) and a connector (26).

The driving sleeve (21) has an inner surface, an outer surface, inner teeth (211) and two bosses (212). The inner teeth (211) are formed on the inner surface of the driving sleeve (21). The bosses (212) are formed on the outer surface of the driving sleeve (21), correspond respectively to, are mounted in and engage with the mounting recesses (113) of the body (11).

The rotating member (22) is mounted in the driving sleeve (21) and has a disc (221), a keyed driving protrusion (222) and a rotating block (223). The disc (221) is mounted in the driving sleeve (21) and has an inner surface and an outer surface. The keyed driving protrusion (222) is formed on and protrudes from the inner surface of the disc (221) and may be quadrangular. The rotating block (223) is formed on the outer surface of the disc (221), is substantially rectangular and has two longitudinal sides, an outer surface, a pivoting surface (2231) and a sliding surface (2232). The pivoting surface (2231) is formed on one longitudinal side of the rotating block (223) and faces the inner teeth (221) of the driving sleeve (21). The sliding surface (2232) is formed on the other longitudinal side of the rotating block (223).

The teeth block (23) is mounted pivotally between the inner teeth (211) of the driving sleeve (21) and the pivoting surface (2231) of the rotating block (223) and has a curved surface, a rotating surface (232), an outer surface, multiple outer teeth (231) and an inserting hole (233). The curved surface corresponds to and engages the inner surface of the driving sleeve (21). The rotating surface (232) is opposite the curved surface and selectively engages the pivoting surface (2231) of the rotating block (223). The outer teeth (231) are formed on the curved surface of the teeth block (23), correspond to and selectively engage the inner teeth (211) of the driving sleeve (21). The inserting hole (233) is formed on the outer surface of the teeth block (23).

The heart-shaped spring (24) is mounted on the teeth block (23) and abuts the outer surface of the rotating block (223) and has an inflection and two pivoting protrusions (241). The pivoting protrusions (241) are formed at the inflection and are mounted in the inserting hole (233) of the teeth block (23) to drive the teeth block (23). When the heart-shaped spring (24) is rotated, the teeth block (23) is also turned to engage the driving sleeve (21).

The drive selector (25) is mounted rotatably on the rotating member (22), connected to the heart shaped spring (24), protrudes out from the opening of the receiving chamber (111) and the rear through hole (1221) of the cap (12) and has an inner surface and a sliding protrusion (252). The sliding protrusion (252) is formed on the inner surface of the drive selector (25), engages and drives the heart-shaped spring (24).

The connector (26) is mounted through the drive selector (25) and is mounted in the rotating block (223) to hold the drive selector (25) rotatably on the rotating member (22).

The shaft (30) is mounted rotatably in the body (11) and securely on the ratchet (20) and has a proximal end (32), a head (331), a keyed recess, a distal end (33), an outer surface and an optional ring mount (311). The ring mount (311) is defined in the outer surface of the shaft (30), is disposed outside the body (11) and may be a keyed surface, hole, recess or the like. The proximal end (32) of the shaft (30) is connected to the ratchet (20), maybe to the keyed driving protrusion (222) of the ratchet (20). The keyed recess is formed in the proximal end of the shaft (30) and corresponds to and engages the ratchet (20), maybe the keyed driving protrusion (222) of the ratchet (20). The head (331) is formed on the distal end (33) of the shaft (30) and may be slotted head, Philips head, a keyed socket head or the like. The keyed socket head allows various different screwdriver bits to be mounted securely on the keyed socket head.

The finger ring (40) is mounted securely around the shaft (30), is smaller than and mounted outside the body (11) and has an optional shaft mount (42). The shaft mount (42) is formed on the finger ring (40) corresponds to and engages the ring mount (311) of the shaft (30) to secure the finger ring (40) to the shaft (30). The shaft mount (42) may be a keyed surface, a bolt a clamp or the like.

Figure 5:
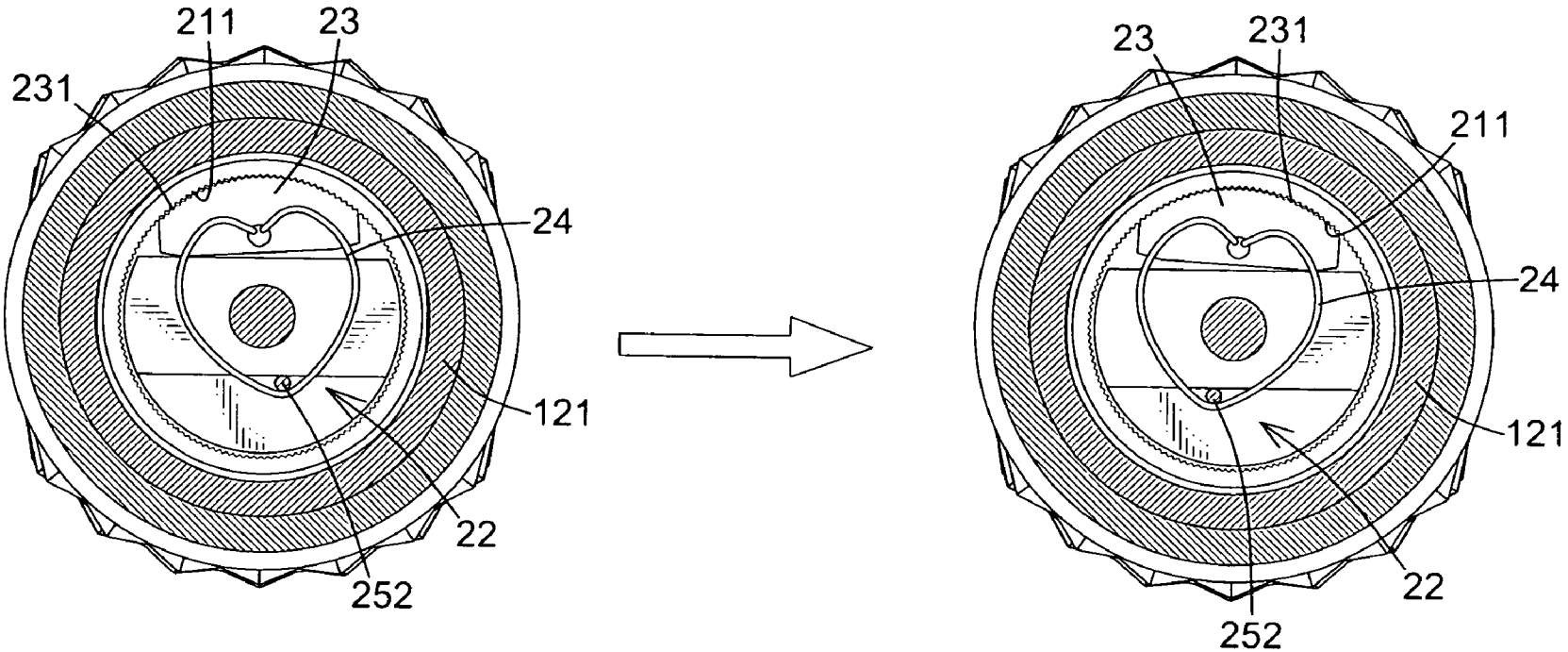
FIG. 5 is an operational rear view in partial section of the ratchet 19 screwdriver in FIG. 1.
Figure 6:
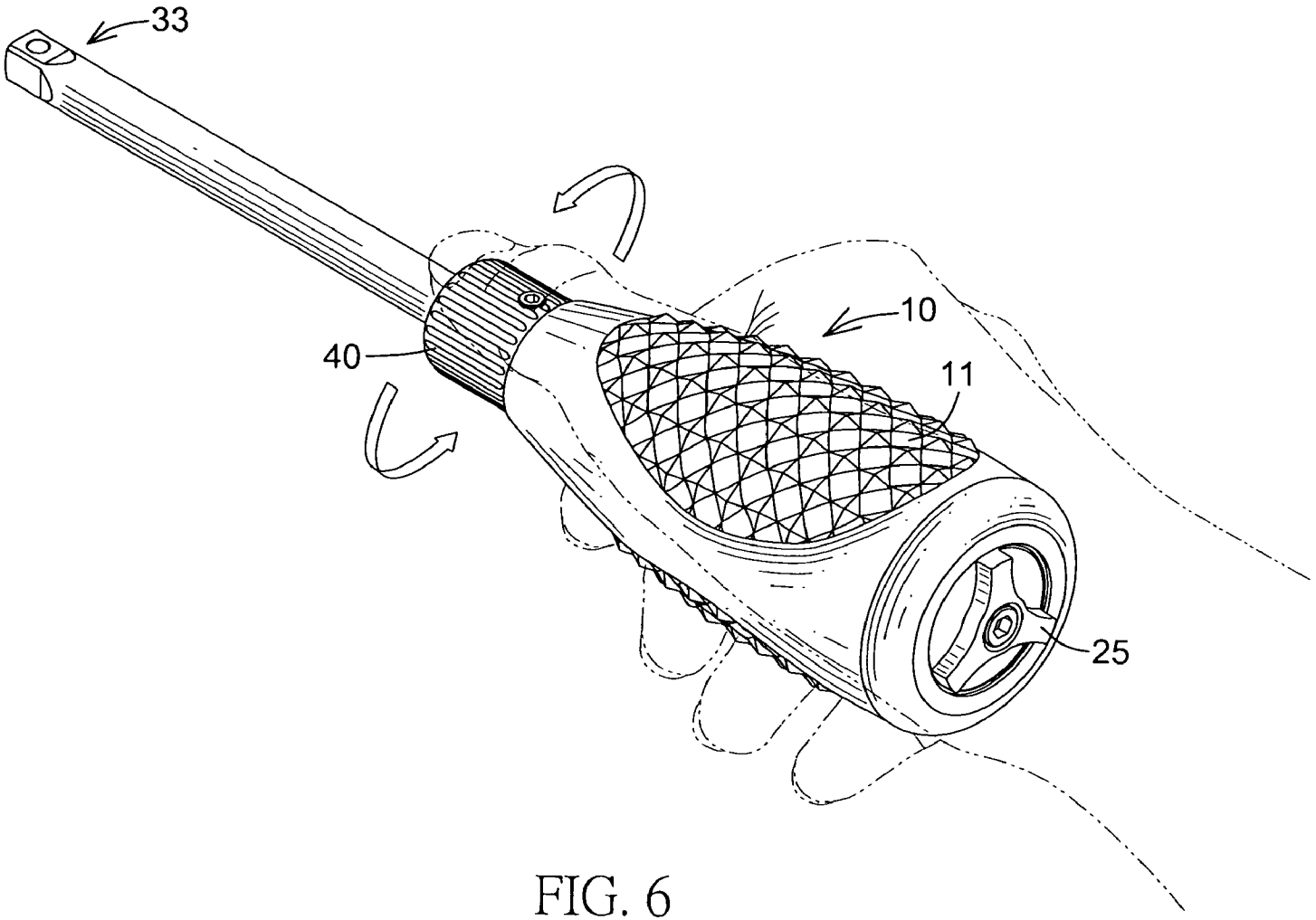
FIG. 6 is an operational perspective view of the ratchet screwdriver in FIG. 1, with a hand shown in phantom lines.

With reference to FIGS. 2, 5 and 6, when the ratchet screwdriver is in use, the distal end (33) of the shaft (30) is connected to a corresponding fastener being a screw, nut, bolt or the like and the drive selector (25) is rotated to determine a drive direction. Then a user can rotate the handle (10) to tighten or loosen the fastener. When starting off tightening or finishing off loosening, very little torque is required to rotate the fastener, so the user can turn the shaft (30) by rotating the finger ring (40) with their fingers. Because the finger ring (40) is smaller and lighter than the body (11), the finger ring (40) can be spun quickly and efficiently, much faster and easier than rotating the handle (10). Therefore, the handle (10) need only be rotated to finish off tightening or start off loosening so saving time, energy and improving comfort of the user.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A ratchet screwdriver comprising:

a handle comprising:

a body having:

a front end;

a rear end;

an inner surface;

a receiving chamber being defined in the body at the rear end and having an opening in the rear end of the body;

a front through hole being defined through the front end of the body and communicating with the receiving chamber;

two mounting recesses being formed oppositely in the inner surface of the body adjacent to the rear end of the body;

a mounting protrusion being smaller than, formed concentrically on and protruding axially from the rear end of the body around the opening of the receiving chamber; and a cap being mounted on the rear end of the body and comprising:

a threaded ring being mounted on the mounting protrusion of the body and closing the mounting recesses in the rear end of the body;

a cover ring corresponding to and being mounted on the annular lip of the body; and a rear through hole being formed axially through the cap and communicating with the receiving chamber;

a ratchet being mounted in the opening of the receiving chamber and engaging the mounting recesses of the body to prevent rotation of the ratchet;

a shaft being mounted rotatably in the body and securely on the ratchet and having a proximal end being connected to the ratchet; and a finger ring being mounted securely around the shaft, being smaller than and disposed outside the body.

2. The ratchet screwdriver as claimed in claim 1, wherein the shaft has a keyed recess formed in the proximal end corresponding to and engaging the ratchet.

3. The ratchet screwdriver as claimed in claim 2, wherein the shaft further has an outer surface; and a ring mount being defined in the outer surface of the shaft and being disposed outside of the body; and the finger ring further has a shaft mount being mounted on the finger ring, corresponding to and engaging the ring mount of the shaft.

4. The ratchet screwdriver as claimed in claim 3, wherein the ratchet further has a driving sleeve having an inner surface;

an outer surface;

inner teeth being formed on the inner surface of the driving sleeve; and two bosses being formed on the outer surface of the driving sleeve, corresponding to and being respectively mounted in the mounting recesses of the body;

a rotating member being mounted in the driving sleeve and having a disc being mounted in the driving sleeve and having an inner surface and an outer surface;

a keyed driving protrusion being formed on and protruding from the inner surface of the disc, corresponding to and being mounting in the keyed recess in the proximal end of the shaft; and a rotating block being formed on the rear surface of the disc being substantially rectangular and having two longitudinal sides;

an outer surface;

a pivoting surface being formed on one of the longitudinal sides of the rotating block and facing the inner teeth of the driving sleeve; and a sliding surface being formed on the other longitudinal side of the rotating block; and a teeth block being mounted pivotally between the inner teeth of the driving sleeve and the pivoting surface of the rotating block and having a curved surface corresponding to and engaging the inner surface of the driving sleeve;

a rotating surface being opposite the curved surface and selectively engaging the pivoting surface of the rotating block;

an outer surface;

outer teeth being formed on the curved surface of the teeth block, corresponding to and selectively engaging the inner teeth of the driving sleeve; and an inserting hole being formed on the outer surface of the teeth block;

a heart-shaped spring being mounted on the teeth block and abutting the outer surface of the rotating block and having an inflection and two pivoting protrusions being formed at the inflection and mounted in the inserting hole of the teeth block to drive the teeth block;

a drive selector being mounted rotatably on the rotating member, connected to the heart shaped spring, protruding out from the opening of the receiving chamber and the rear through hole and having an inner surface; and a sliding protrusion being formed on the inner surface of the drive selector, engaging and driving the heart-shaped spring; and a connector being mounted through the drive selector and being mounted in the rotating block to hold the drive selector rotatably on the rotating member.

5. The ratchet screwdriver as claimed in claim 4, wherein the shaft further has a distal end and a head being formed on the distal end, wherein the head is a keyed socket head allowing various screwdriver bits to be mounted securely on the keyed socket head.

6. The ratchet screwdriver as claimed in claim 2, wherein the ratchet further has a driving sleeve having an inner surface;

an outer surface;

inner teeth being formed on the inner surface of the driving sleeve; and two bosses being formed on the outer surface of the driving sleeve, corresponding to and being respectively mounted in the mounting recesses of the body;

a rotating member being mounted rotatably in the driving sleeve and having a disc being mounted in the driving sleeve and having an inner surface and an outer surface;

a keyed driving protrusion being formed on and protruding from the inner surface of the disc, corresponding to and being mounting in the keyed recess in the proximal end of the shaft; and a rotating block being formed on the rear surface of the disc being substantially rectangular and having two longitudinal sides;

an outer surface;

a pivoting surface being formed on one of the longitudinal sides of the rotating block and facing the inner teeth of the driving sleeve; and a sliding surface being formed on the other longitudinal side of the rotating block; and a teeth block being mounted pivotally between the inner teeth of the driving sleeve and the pivoting surface of the rotating block and having a curved surface corresponding to and engaging the inner surface of the driving sleeve;

a rotating surface being opposite the curved surface and selectively engaging the pivoting surface of the rotating block;

an outer surface, outer teeth being formed on the curved surface of the teeth block, corresponding to and selectively engaging the inner teeth of the driving sleeve; and an inserting hole being formed on outer surface of the teeth block;

a heart-shaped spring being mounted on the teeth block and abutting the outer surface of the rotating block and having an inflection and two pivoting protrusions being formed at the inflection and mounted in the inserting hole of the teeth block to drive the teeth block;

a drive selector being mounted rotatably on the rotating member, connected to the heart shaped spring, protruding out from the opening of the receiving chamber and the rear through hole and having an inner surface; and a sliding protrusion being formed on the inner surface of the drive selector, engaging and driving the heart-shaped spring; and a connector being mounted through the drive selector and being mounted in the rotating block to hold the drive selector rotatably on the rotating member.

7. The ratchet screwdriver as claimed in claim 1, wherein the shaft further has an outer surface; and a ring mount being defined in the outer surface of the shaft and being disposed outside the body; and the finger ring further has a shaft mount being mounted on the finger ring, corresponding to and engaging the ring mount of the shaft.

8. The ratchet screwdriver as claimed in claim 1, wherein the shaft further has a distal end and a head being formed on the distal end, wherein the head is a keyed socket head allowing various screwdriver bits to be mounted securely on the keyed socket head.

* * * * *